US006843863B2

(12) United States Patent
DeYoung et al.

(10) Patent No.: US 6,843,863 B2
(45) Date of Patent: Jan. 18, 2005

(54) ALUMINUM ALLOYS HAVING IMPROVED CAST SURFACE QUALITY

(75) Inventors: David H. DeYoung, Export, PA (US); William F. McGinnis, New Kensington, PA (US); Ray T. Richter, Murrysville, PA (US); Jeffrey J. Wiesner, Maryville, TN (US)

(73) Assignee: Alcoa Inc., Pittsburgh, PA (US)

( * ) Notice: Subject to any disclaimer, the term of this patent is extended or adjusted under 35 U.S.C. 154(b) by 103 days.

(21) Appl. No.: 10/053,208

(22) Filed: Jan. 18, 2002

(65) Prior Publication Data

US 2002/0084007 A1 Jul. 4, 2002

Related U.S. Application Data

(62) Division of application No. 09/685,283, filed on Oct. 10, 2000.

(51) Int. Cl.[7] ..... C22C 21/10

(52) U.S. Cl. ..... 148/415; 148/417; 420/532; 420/541

(58) Field of Search ..... 148/415–418; 420/532, 541

(56) References Cited

U.S. PATENT DOCUMENTS

| | | | | |
|---|---|---|---|---|
| 2,166,496 A | * | 7/1939 | Igarashi et al. | 420/532 |
| 4,377,425 A | | 3/1983 | Otani et al. | 148/437 |
| 5,230,754 A | | 7/1993 | Setzer et al. | 148/437 |
| 5,250,125 A | | 10/1993 | Koch et al. | 148/549 |
| 5,469,911 A | | 11/1995 | Parker | 164/467 |
| 5,496,426 A | * | 3/1996 | Murtha | 148/691 |
| 5,529,748 A | | 6/1996 | Moreton et al. | 420/529 |
| 6,073,677 A | | 6/2000 | Bäckerud et al. | 164/4.1 |

FOREIGN PATENT DOCUMENTS

| | | |
|---|---|---|
| JP | 1156446 | 6/1989 |
| JP | 8134578 | 5/1996 |
| JP | 10158771 | 6/1998 |

OTHER PUBLICATIONS

"International Alloy Designations and Chemical Composition Limits for Wrought Aluminum and Wrought Aluminum Alloys", p. 1.*

Derwent Publications Ltd., Abstract SU778314.

Spiekermann, P., "Legierungen—Ein Besonderes Patentrechtliches Problem?—Legierung Spruefung Im Europaeischen Patentamt" Mitteilungen der Deutschen Patentanwaelte, Heymann, Koln, DE 1993, pp. 178–190.

Spiekermann, P., "Alloys—A Special Problem of Patent Law?—Alloy Examination in the European Patent Office", non–published English translation of document, pp. 1–20.

* cited by examiner

*Primary Examiner*—George Wyszomerski
*Assistant Examiner*—Janelle Morillo
(74) *Attorney, Agent, or Firm*—Matthew W. Smith

(57) ABSTRACT

Aluminum alloy compositions are disclosed, which include small amounts of calcium that result in improved surface properties of the cast aluminum. The calcium, and up to 0.25% grain refiners, are added along with alkaline earth metals, transition metals and/or rare earth metals to the aluminum alloy as a melt. The addition results in improved appearance, substantially reduced surface imperfections and reduced surface oxidation in cast ingot aluminum and aluminum alloys. The addition of small amounts of these additives, surprisingly were found to substantially eliminate vertical folds, pits and ingot cracking in more than one ingot casting technique. The additions also improved the appearance of the ingots, including reflectance. As a result, the ingots could be reduced or worked essentially right out of the casting without first conditioning the surface by, for example, scalping. Also disclosed is a method of improving the surface properties and preventing surface imperfections and cracking of cast aluminum alloys. The method includes the steps of adding calcium to a molten aluminum alloy that is essentially free of Be and casting the aluminum alloy using any commonly used technique.

30 Claims, 8 Drawing Sheets

ALUMINUM ALLOYS HAVING IMPROVED CAST SURFACE QUALITY

This application is a divisional of U.S. patent application Ser. No. 09/685,283, filed Oct. 10, 2000.

BACKGROUND OF THE INVENTION

1. Field of the Invention

The present invention relates generally to aluminum alloy compositions and, more particularly, to improving the surface quality of aluminum ingots produced therefrom through closely controlled alloying additions, which improve downstream processing and yields.

2. Description of the Prior Art

It is well known in the aluminum casting art that various surface imperfections such as pits, vertical folds, oxide patches and the like, which form during ingot casting, can develop into cracks during casting or in later processing. A crack in an ingot or slab propagates during subsequent rolling, for example, leading to expensive remedial rework or outright scrapping of the cracked material. Most ingots are worked in some manner; however, working will not heal a cracked ingot. Surface imperfections in aluminum cast ingots remains a problem in the alloy art.

Working refers to various operations well-known in the metallurgy art, which include hot rolling, cold rolling, extruding, forging, drawing, ironing, heat treating, aging, forming, and stretching, to name a few. In working or forming an alloy, energy is put into the workpiece, but it is not always homogeneously distributed.

The casting of alloys may be promoted by any number of methods known to those skilled in the art, such as direct chill casting (DC), electromagnetic casting (EMC), horizontal direct chill casting (HDC), hot top casting, continuous casting, semi-continuous casting, die casting, roll casting and sand casting. Each of these casting methods has a set of its own inherent problems, but with each technique, surface imperfections can still be an issue. One mechanical means of removing surface imperfections from an aluminum alloy ingot is scalping. Scalping involves the machining off a surface layer along the sides of an ingot after it has solidified.

Aluminum alloys may comprise any of the Aluminum Association ("AA") registered alloys such as the 1xxx, 2xxx, 3xxx, 4xxx, 5xxx, 6xxx, 7xxx and 8xxx series alloys. Certain alloys, such as 7050 and other 7xxx alloys as well as 5182 and 5083 are especially prone to surface defects and cracking. In the past, beryllium has been added, usually at part per million (ppm) levels to some of these alloys to control surface defects. However, beryllium has been banned from aluminum products used for food and beverage packaging. Further, there have been increased concerns over the health risks associated with factory workers using beryllium and products containing beryllium. For this reason, although beryllium is effective at controlling surface defects in aluminum cast ingots, a suitable replacement is needed.

U.S. Pat. No. 5,469,911 to Parker discloses a method for improving the surface quality of electromagnetically cast aluminum alloy ingots, which includes the addition of 0.01 to 0.04 wt. % calcium prior to the ingot head of an ingot mold. These levels of calcium are significantly higher than the ppm levels employed with beryllium. Such high levels of calcium can adversely affect the properties of the alloy.

U.S. Pat. No. 4,377,425 to Otani et al. discloses using calcium in high iron containing direct chill cast aluminum alloy ingots to minimize the occurrence of dendritic or so-called "fir tree" crystal structures with a grain size of less than 150 microns. This method was particularly useful for AA1000 and AA5000 series aluminum alloys. The effect, if any, of calcium on the surface quality of the resulting ingots was not disclosed by Otani et al.

Historically, in the melting and casting of aluminum alloys, calcium, as well as sodium, were considered to be unwanted elements because of edge cracking problems. These elements typically have been removed from the melt by way of chlorine gas fluxing prior to ingot casting.

There remains a need for an effective alternative to beryllium to prevent surface imperfections such as vertical folds, pits, oxide patches and the like from forming during aluminum ingot casting. Such a method would be instrumental in preventing cracks, which can form during casting or can develop in later processing. Finally, the method preferably would have no adverse affect on alloy properties.

SUMMARY OF THE INVENTION

The present invention is directed to the addition of small amounts of calcium to an aluminum alloy to improve the surface properties of the cast aluminum ingot. The calcium, and up to 0.25% grain refiners such as titanium boride, are added along with alkaline earth metals, transition metals, rare earth metals and/or other elements to the aluminum alloy as a melt. The addition results in improved as-cast surface appearance, substantially reduced surface imperfections and/or reduced surface oxidation in cast ingot aluminum and aluminum alloys. The addition of small amounts of these additives, surprisingly were found to substantially eliminate vertical folds, pits and ingot cracking in more than one ingot casting technique. The additions also improved the appearance of the ingots, including reflectance. As a result, the ingots could be reduced or essentially worked directly out of the casting process without first conditioning the surface by, for example, scalping.

The aluminum alloy of the present invention contains from 5 to 1,000 ppm calcium, up to 0.25% grain refiners and essentially no Be. The alloy may contain less than 0.2% Fe. The aluminum alloy may further contain alkaline earth metals, transition metals, rare earth metals and/or other elements required to provide the desired properties.

We have further discovered that significantly less Ca is required to eliminate surface defects in conjunction with a Ti—C grain refiner rather than in conjunction with a Ti—B grain refiner.

The present invention is further directed to a method of improving the surface properties and preventing surface imperfections and cracking of cast aluminum alloys. The present method includes the steps of adding calcium to a molten aluminum alloy that essentially is free of Be and casting the aluminum alloy using any commonly used techniques.

These and other advantages of the present invention will be clarified in the description of the preferred embodiments taken together with the attached drawings in which like reference numerals represent like elements throughout.

DESCRIPTION OF THE PREFERRED EMBODIMENTS

Figure 1:
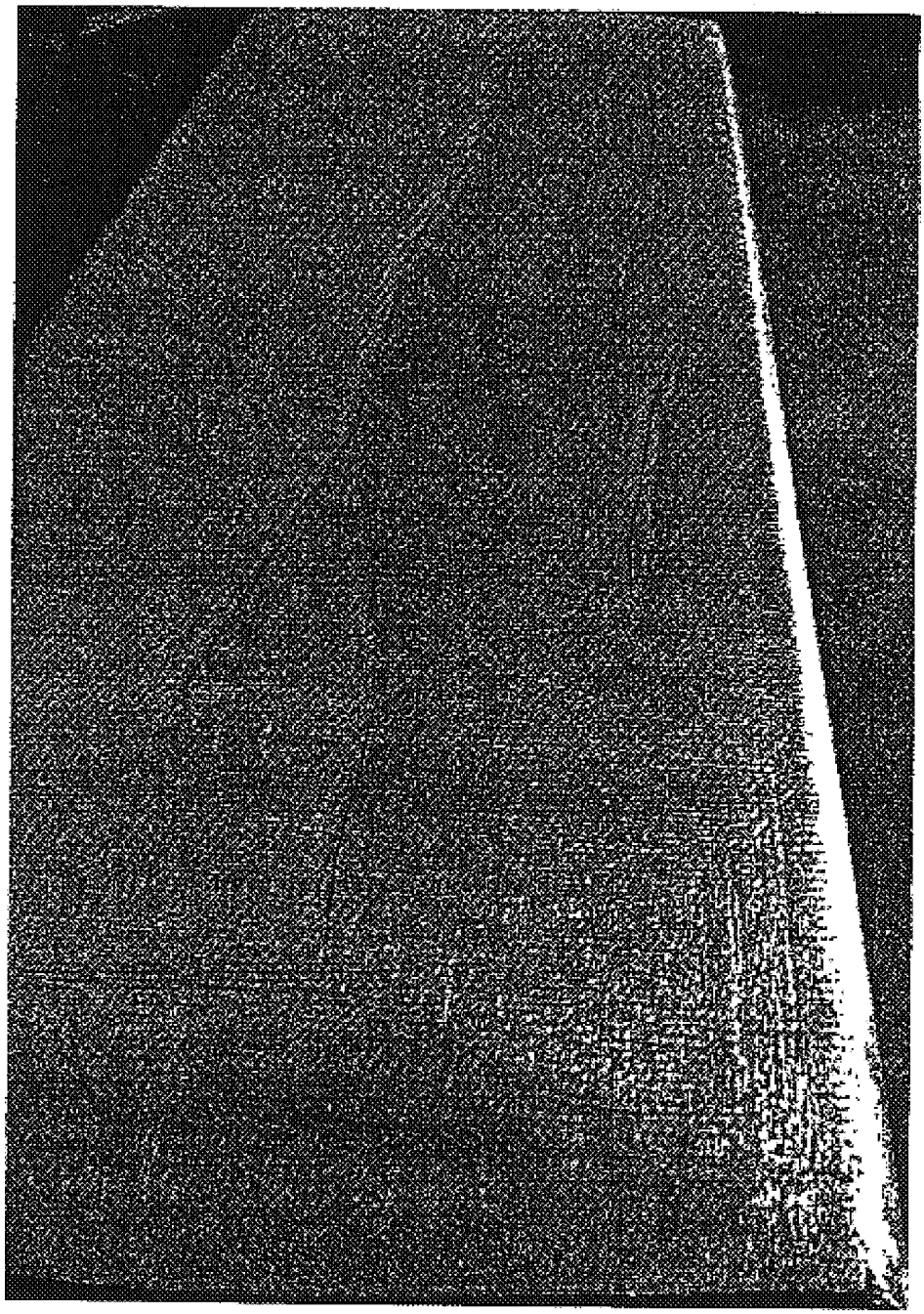
Fig. 1 PRIOR ART
FIG. 1 is a photograph of an as-cast aluminum alloy ingot that has no beryllium or calcium added.
Figure 2:
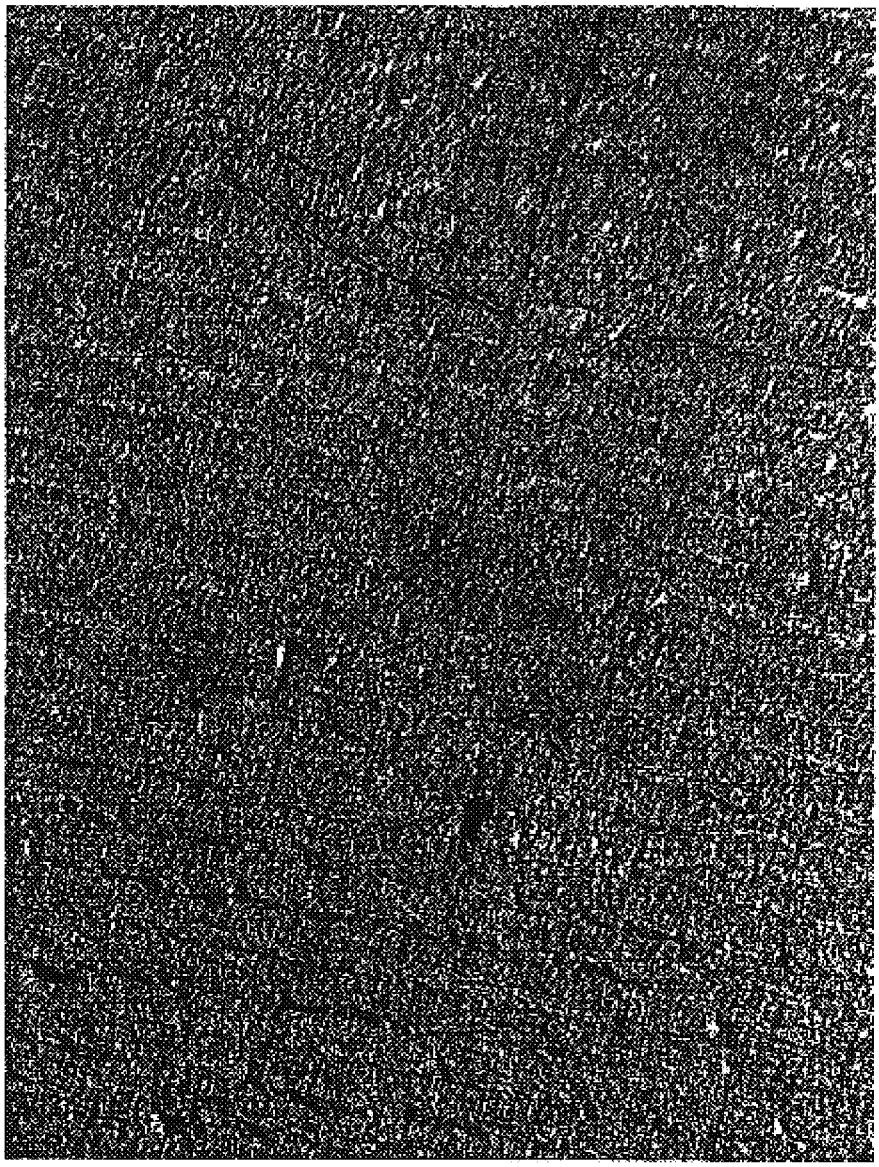
Fig. 2 PRIOR ART
FIG. 2 is a photograph showing a close-up view of a surface portion of the aluminum alloy ingot of FIG. 1 showing a crack initiation site.
Figure 3:
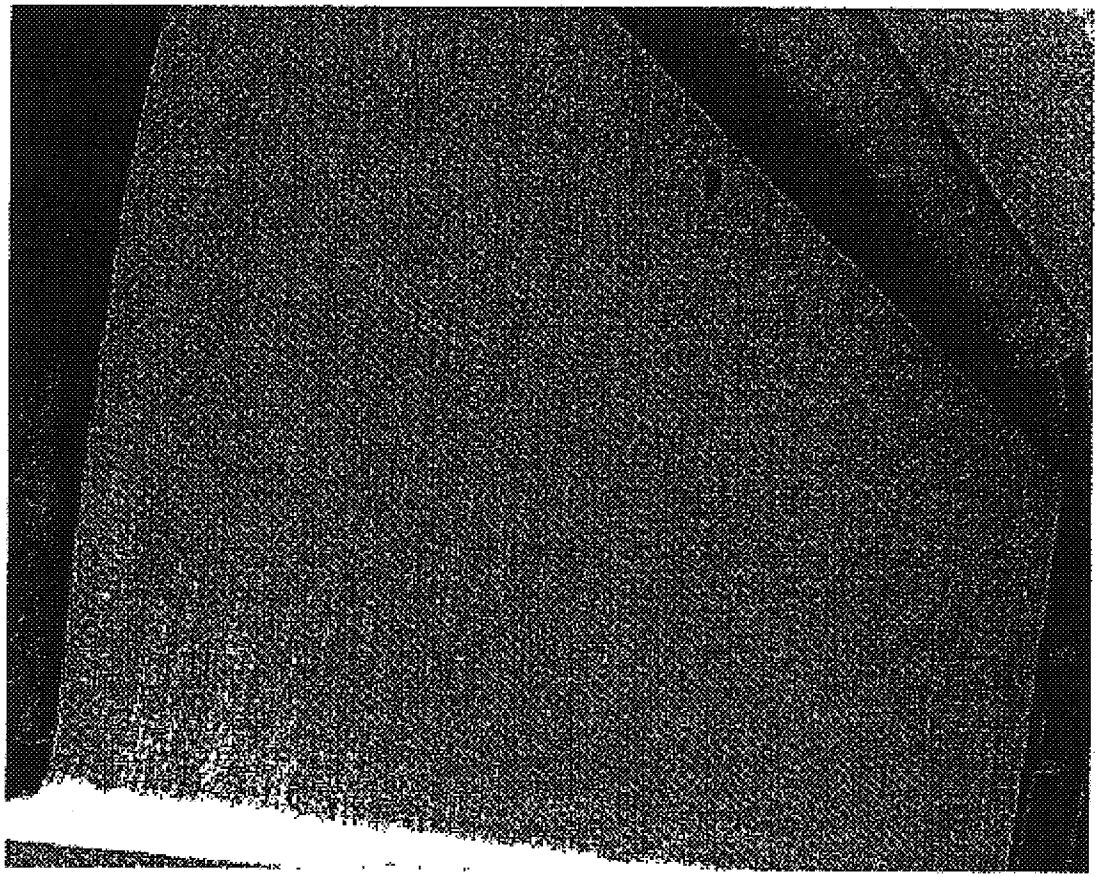
Fig. 3 PRIOR ART
FIG. 3 is a photograph of an as-cast aluminum alloy ingot that includes an addition of 12 ppm Be.
Figure 4:
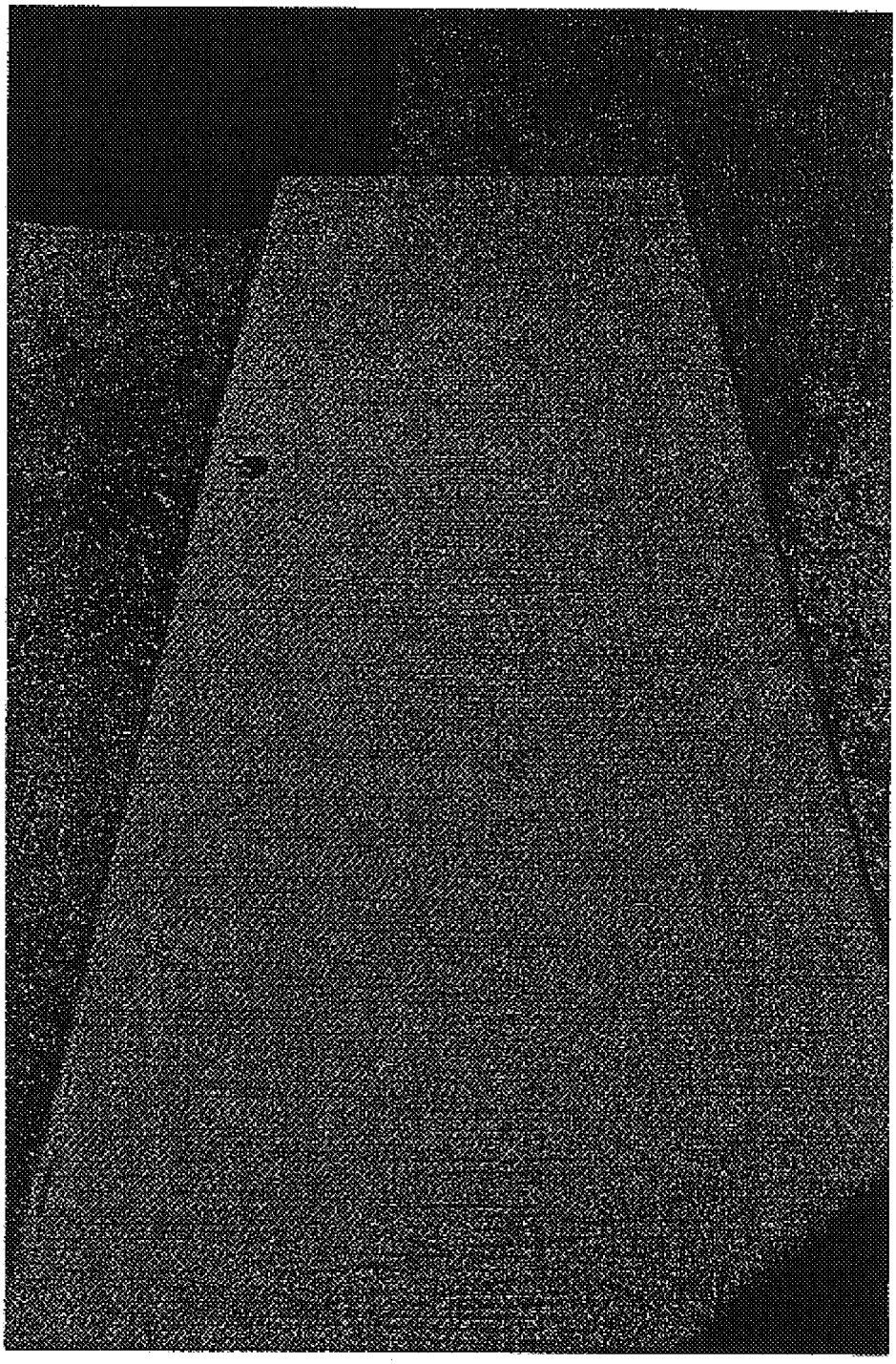
FIG. 4 is a photograph of an as-cast aluminum alloy ingot that includes an addition of 240 ppm (0.024%) Ca in accordance with the invention.
Figure 5:
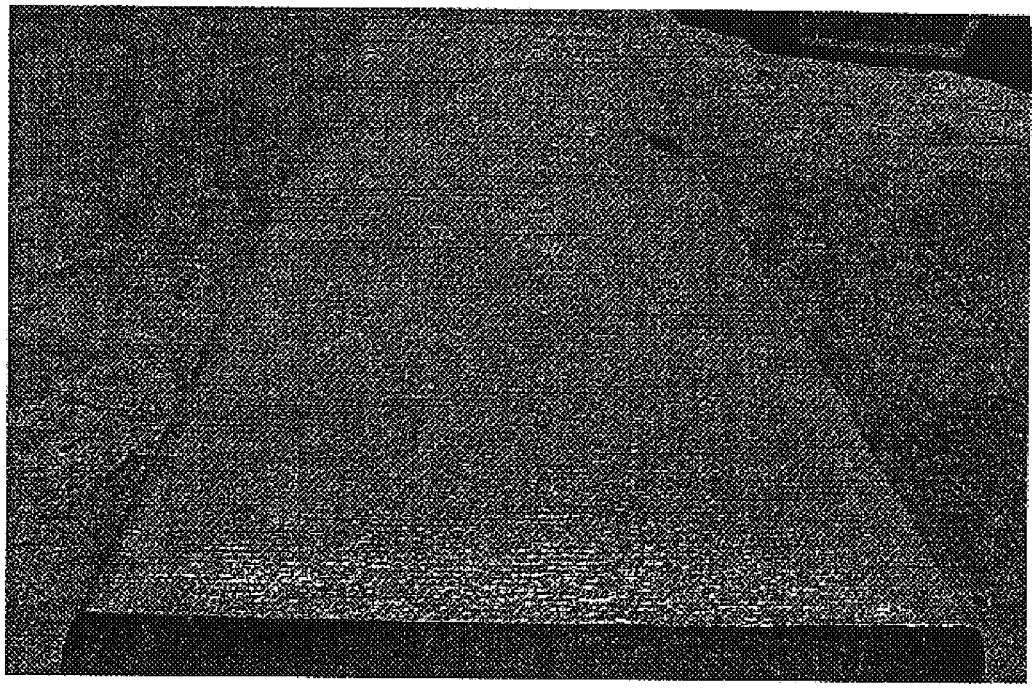
FIG. 5 is a photograph of an aluminum alloy ingot that includes an addition of 53 ppm (0.0053%) Ca in accordance with the invention.

Other than in the operating examples, or where otherwise indicated, all numbers or expressions referring to quantities of ingredients, reaction conditions, etc., used in the specification and claims are to be understood as modified in all instances by the term "about."

The aluminum alloy of the present invention contains from 5 to 1,000 ppm, preferably from 10 to 750 ppm and most preferably from 15 to 500 ppm of calcium; up to 0.25%, preferably 0.001 to 0.25% and most preferably 0.1 to 0.25% grain refiners, less than 0.2%, preferably less than 0.19% and most preferably from 0.001 to 0.19% Fe, essentially no Be, with the balance being aluminum and inevitable impurities. The aluminum alloy may further contain alkaline earth metals, transition metals, rare earth metals and/or other elements required to provide the desired properties.

The amount of calcium in the aluminum alloy composition of the present invention is any amount necessary to improve the surface properties and prevent surface imperfections and cracking of castings of the aluminum alloy. The amount of calcium required can be 8 to 15 ppm, 15 to 300 ppm, 20 to 250 ppm, 25 to 200 ppm, or 25 to 150 ppm depending on the aluminum alloy being cast.

One or more grain refiners will be included in the aluminum alloy composition of the present invention. Agents that promote grain refinement of aluminum include transition metals such as Ti; metals such as Sr; and non-metals such as B, and C, which are added to the molten metal. Preferred grain refiners are Ti, B and C.

As used herein the term "grain refiner" refers to well-known pre-alloyed materials, usually in solid rod or wire form which are continuously added to the casting stream or to the aluminum alloy melt to achieve a desirable fine grain size in the solidified ingot. The typical grain refiner systems comprise Ti—B or Ti—C alloyed with aluminum in ⅜" diameter rod form. Commonly used grain refiner alloys include 3% Ti—1% B— balance Al; 3% Ti—0.15% C—balance Al; 5% Ti—1% B—balance Al; 5% Ti—0.2% B—balance Al; and 6% Ti—0.02% C—balance Al. The Ti, B and C levels contained in a solidified aluminum alloy after casting when using these typical grain refiner materials is as follows:

| (in % by weight) | | |
|---|---|---|
| Ti | broad range: | 0.0002% to 0.20% |
| Ti | preferred range: | 0.0003% to 0.10% |
| B | broad range: | 0.0001% to 0.03% |

-continued

| (in % by weight) | | |
|---|---|---|
| B | medium range: | 0.0001% to 0.01% |
| B | preferred range: | 0.0003% to 0.005% |
| C | broad range: | 0.00001% to 0.001% |
| C | preferred range: | 0.000015% to 0.0004% |

The aluminum alloy of the present invention will include all of the Aluminum Association Registered Alloys such as the 1xxx, 2xxx, 3xxx, 4xxx, 5xxx, 6xxx, 7xxx and 8xxx families of alloys. Preferred alloys are AA2xxx, AA3xxx, AA5xxx and AA7xxx. More preferred alloys include AA5xxx and AA7xxx. Most preferred alloys include AA5182, AA5083, AA7050 and AA7055. Of course, other non-AA registered alloys may also benefit from the present invention.

We have also found that the addition of calcium to the aluminum alloy melt results in fewer oxides being created on the surface of the cast aluminum alloy ingot. The significance of inhibiting the creation of certain surface defects to the ingot makes it possible to make a shallower scalp or perhaps not having to scalp the ingot at all. The present invention thus provides for less alloy waste from the ingot because less or no scalping is required.

The present invention is further directed to a method of improving the as-cast surface properties and preventing surface imperfections and cracking of ingot cast aluminum alloys. The present method includes a first step of adding from 5 to 5,000 ppm, preferably from 5 to 1,000 ppm, more preferably from 10 to 750 ppm and most preferably from 15 to 500 ppm of calcium to a molten aluminum alloy that is essentially free of Be. When a Ti—B grain refiner is employed, about 25–30 ppm Ca is effective in eliminating surface defects and when a Ti—C grain refiner is used, about 8–14 ppm Ca is effective. The aluminum alloy may contain less than 0.2% Fe, preferably less than 0.19% and most preferably from 0.001 to 0.19%, Fe. The aluminum alloy also preferably includes up to 0.25%, preferably 0.001 to 0.25% and most preferably 0.1 to 0.25% of one or more grain refiners. The aluminum alloy may further contain alkaline earth metals, transition metals, rare earth metals and/or other elements required to provide the desired properties and Aluminum Association standard alloy composition.

The second step of the method of the invention comprises casting the aluminum alloy using any of the commonly used casting techniques. Such commonly used casting techniques include direct chill casting (DC), electromagnetic casting (EMC), horizontal direct chill casting (HDC), hot top casting, continuous casting, semi-continuous casting, die casting, roll casting, sand casting and other methods known to those skilled in the art.

Optionally, and if required, the cast aluminum alloy ingot may be worked. Working includes the various post casting operations known in the alloying art, which include hot rolling, cold rolling, extruding, forging, drawing, ironing, heat treating, aging, forming, stretching, scalping and other techniques known to those skilled in the art.

The method of the present invention is particularly effective in improving the surface properties and preventing surface imperfections and cracking of cast aluminum alloys of Aluminum Association Registered Alloys 1xxx, 2xxx, 3xxx, 4xxx, 5xxx, 6xxx, 7xxx and 8xxx. Preferred alloys that can be made into ingots using the present method are AA2xxx, AA3xxx, AA5xxx and AA7xxx. More preferred alloys include AA5xxx and AA7xxx. Most preferred alloys include AA7050, AA5182, AA5083 and AA7055.

The minimization of oxidation of molten alloys and surface imperfections in resulting ingots increases the recovery rate of the aluminum alloy at various process steps. The increased recovery rate results in reduced production costs and an increase in the output of a production facility. Particularly, reduced oxidation results in reduced melt loss, which are losses that occur during melting, holding and casting.

EXAMPLES 1–5

Ingots of cross section 16"×50" were vertically cast using a direct chill (DC) casting method. The ingots were cast to a length of 180". Molten aluminum alloy flowed from a holding furnace through a single stage in-line degassing unit, through a molten metal filter, through a spout and into the ingot mold. The aluminum alloy was an AA7000 series composition. The ingots are described in Table 1.

TABLE 1

| Example Number | Be or Ca addition/ Grain Refiner | Ingot Description | FIG. Reference |
|---|---|---|---|
| 1 | none | numerous cracks | 1 |
| 2 | none | numerous cracks | 2 |
| 3 | 12 ppm Be<br>3% Ti—1% B | no cracks | 3 |
| 4 | 240 ppm Ca<br>3% Ti—1% B | no cracks | 4 |
| 5 | 53 ppm Ca<br>3% Ti—0.15% C | no cracks | 5 |

In Table 1, "no cracks" is meant to indicate that there were no visible pits, folds or cracks on the surface of the ingot. Examples 1 and 2 had cracks to the extent that the ingots were unusable. FIGS. 1–5 show the respective ingots from these above examples. These examples demonstrate that the addition of calcium to an AA7xxx aluminum alloy prevents cracking in the same way that beryllium does. The very low calcium addition of 53 ppm or 0.0053 wt. % in conjunction with a standard addition of a grain refiner of 3% Ti—0.15% C (Example 5) surprisingly was found to be effective in pits or folds on the ingot surface.

EXAMPLES 6–10

Figure 6A:
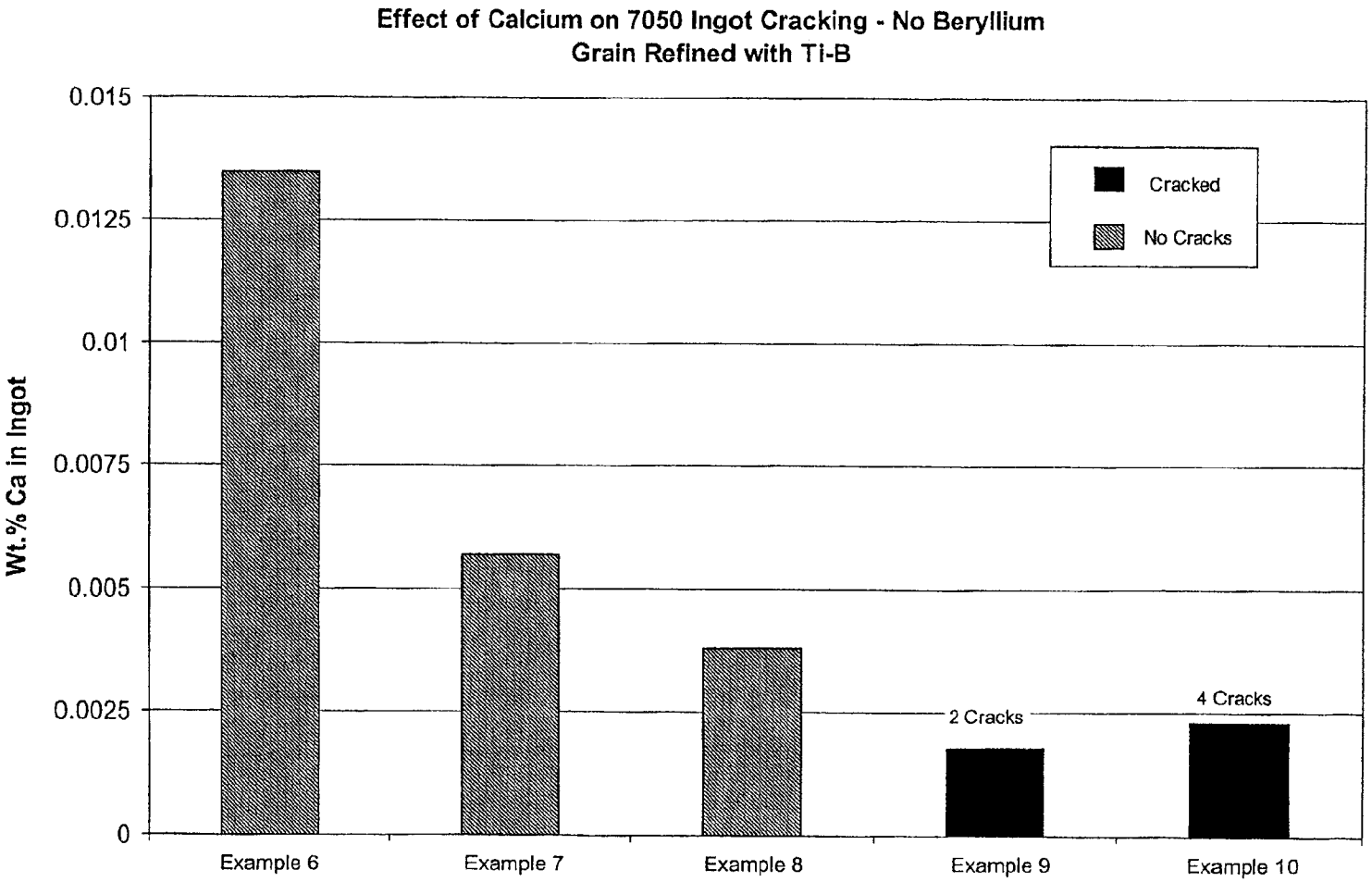
FIGS. 6*a* and 6*b* are bar graphs showing the relationship between aluminum alloy Ca content and the development of surface cracks.

Examples 6–10 were prepared as outlined above. An AA7050 aluminum allow, which included a standard addition of a 3% Ti—1% B grain refiner and the amount of calcium was varied to determine the level necessary to prevent surface imperfections. The data from these examples is summarized as a bar chart in FIG. 6*a*. The data indicates that for levels of calcium above approximately 25 ppm, no cracks were observed.

EXAMPLES 5, 18–25

Figure 6B:
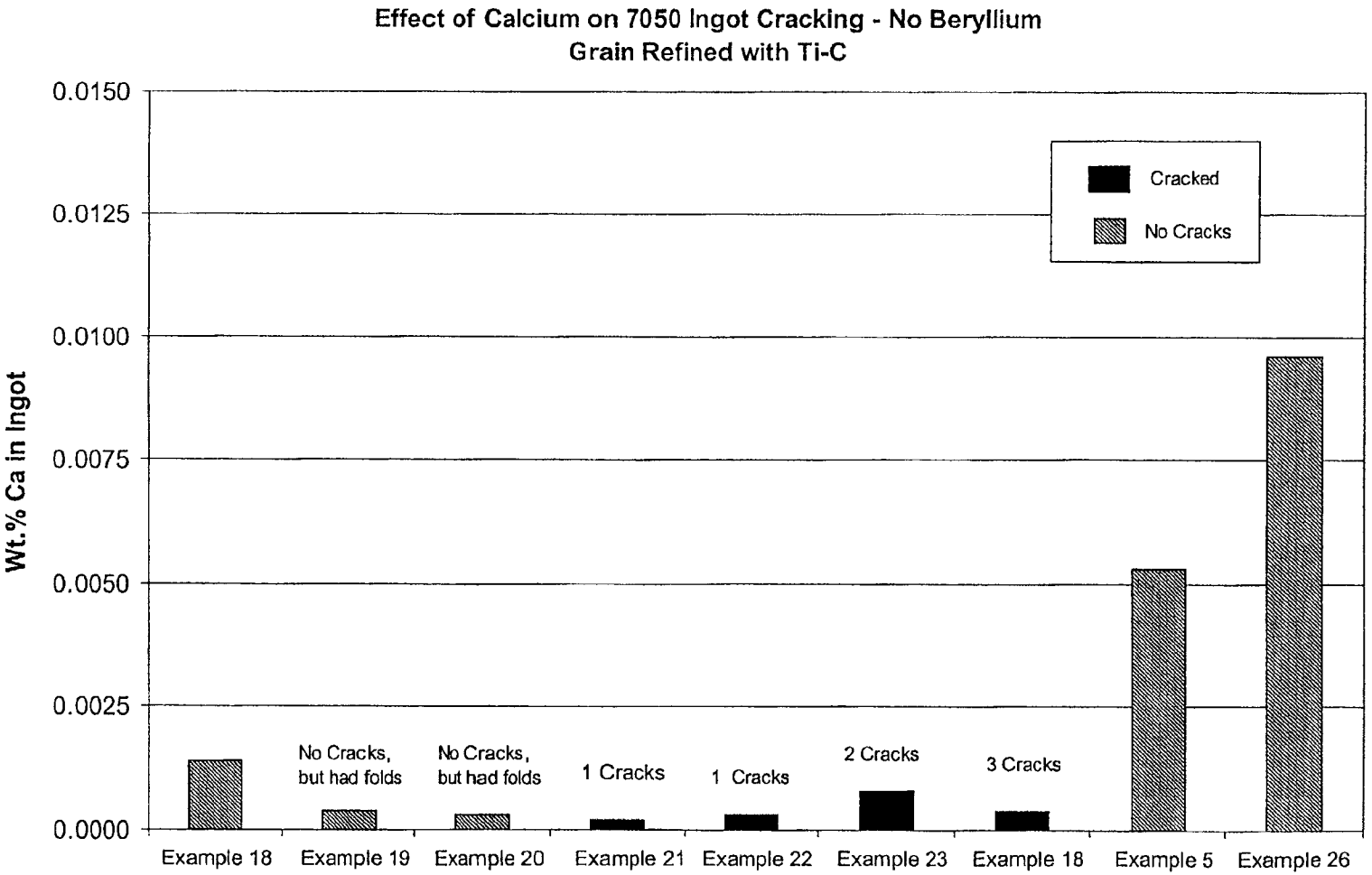

Examples 5, 18–25 were prepared the same as Examples 6–10 using an AA7050 aluminum alloy but with a 3% Ti—0.15% C grain refiner. The data from these examples is summarized as a bar chart in FIG. 6*b* with varying amounts of Ca as follows: Example 5–53 ppm Ca; Example 18–14 ppm Ca; Example 19–4 ppm Ca; Example 20–3 ppm Ca; Example 21–2 ppm Ca; Example 22–3 ppm Ca; Example 23–8 ppm Ca; Example 24–4 ppm Ca; and Example 25–96 ppm Ca. The data indicates that Ca levels of between about 10 ppm and 50 ppm or upwards to 100 ppm appear effective with a Ti 0 C grain refiner in eliminating surface defect.

EXAMPLES 11–17

Figure 7:
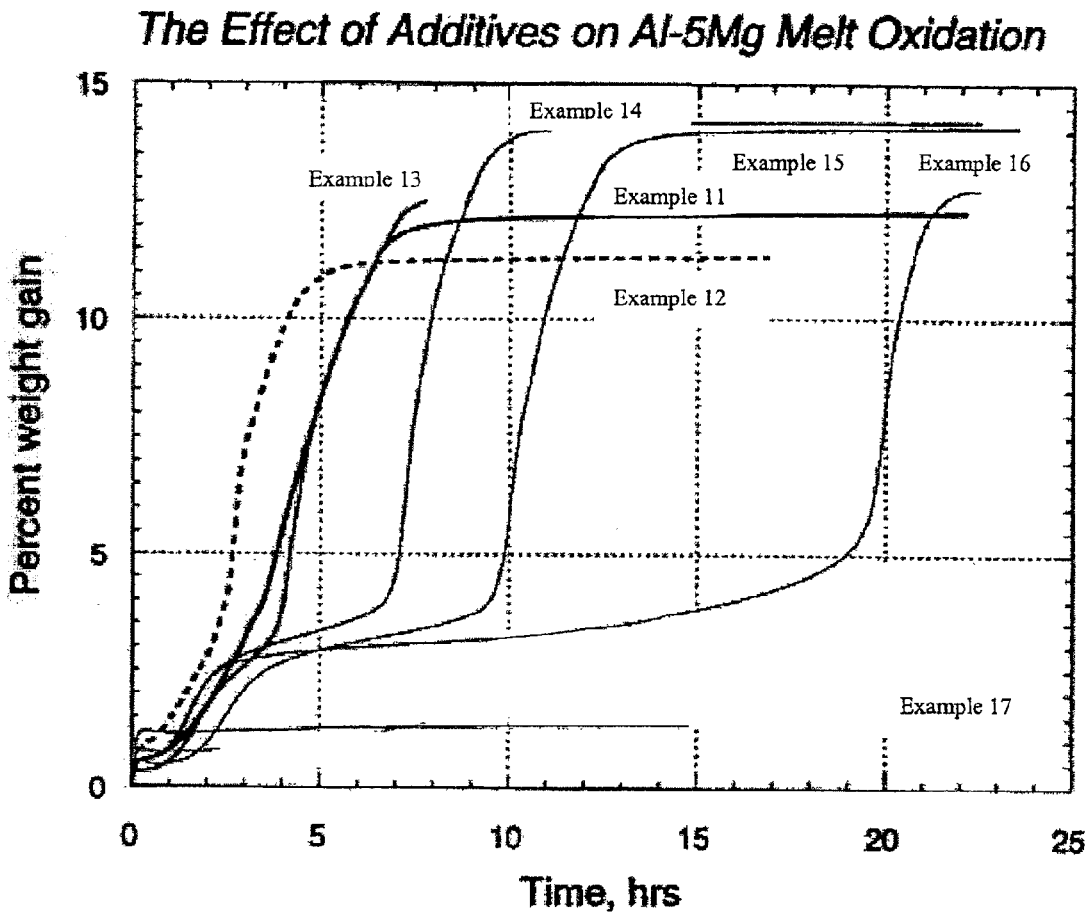
FIG. 7 is a graph showing the relationship between 7xxx series aluminum alloy composition and surface oxidation.

Examples 11–17 are measurements of oxidation on an Al—5 Mg alloy melt. The TGA plots (FIG. 7) show the weight gain due to oxidation over time for the various Examples. The plots demonstrate the significant reduction in oxidation when 300 ppm 0.03% calcium (Example No. 17) is included in the alloy as compared to no additive (Examples Nos. 11 and 12) in refining additives 3% Ti—1% B (Example No. 13), 6% Ti—0.02% C (Example No. 14), 3% Ti—0.15% C (Example No. 15) and 6% Ti (Example No. 16).

TABLE 2

| Example | Additive(s) ppm/wt. % |
|---|---|
| 11 | none |
| 12 | none |
| 13 | 3% Ti, 1% B |
| 14 | 6% Ti, 0.02% C |
| 15 | 3% Ti, 0.15% C |
| 16 | 6% Ti |
| 17 | 300 ppm (0.03%) Ca |

The invention has been described with reference to the preferred embodiments. Obvious modifications and alterations will occur to others upon reading and understanding the preceding detailed description. It is intended that the invention be construed as including all such modifications and alterations insofar as they come within the scope of appended claims or the equivalents thereof.

We claim:

1. An AA7000 series aluminum alloy having improved as-cast surface quality, said alloy is comprised of from about 5 to about 75 ppm calcium, from about 0.001% to about 0.25% grain refiners, and being essentially beryllium-free.

2. The aluminum alloy as claimed in claim 1 wherein the grain refiners are selected front the group consisting of Ti, Sr, B and C.

3. An ingot cast from the aluminum alloy of claim 1.

4. The alloy of claim 1, wherein the concentration of calcium is from about 10 to about 75 ppm calcium.

5. The alloy of claim 1, wherein the concentration of calcium is from about 15 to about 75 ppm calcium.

6. The alloy of claim 1, wherein the concentration of grain refiners is from about 0.1 to about 0.25 wt. %.

7. The alloy of claim 1, wherein titanium is a grain refiner and the concentration of titanium is from about 0.0002 to about 0.20 wt. %.

8. The alloy of claim 1, wherein titanium is a grain refiner and the concentration of titanium is from about 0.0003 to about 0.10 wt. %.

9. The alloy of claim 1, wherein boron is a grain refiner and the concentration of boron is from about 0.0001 to about 0.03 wt. %.

10. The alloy of claim 1, wherein boron is a grain refiner and the concentration of boron is from about 0.0001 to about 0.01 wt. %.

11. The alloy of claim 1, wherein boron is a grain refiner and the concentration of boron is about from about 0.0003 to about 0.005 wt. %.

12. The alloy of claim 1, wherein carbon is a grain refiner and the concentration of carbon is from about 0.00001 to about 0.001 wt. %.

13. The alloy of claim 1, wherein carbon is a grain refiner and the concentration of carbon is from about 0.000015 to about 0.0004 wt.

14. The alloy of claim 1, wherein titanium is a grain refiner at a concentration from about 0.0002 to about 0.20 wt. % and boron is a grain refiner at a concentration from about 0.0001 to about 0.03 wt. %.

15. The alloy of claim 1, wherein titanium is a grain refiner at a concentration from about 0.0002 to about 0.20 wt. % and carbon is a grain refiner at a concentration from about 0.00001 to about 0.001 wt. %.

16. The alloy of claim 15, wherein the concentration of calcium is from about 8 ppm to about 14 ppm.

17. An aluminum alloy having improved as-cast surface quality, said alloy consisting essentially of: about 5.7 to about 6.7 wt. % zinc, about 2.0 to about 2.6 wt. % copper, about 1.9 to about 2.6 wt. % magnesium, about 0.08 to about 0.15 wt % zirconium, about 5 to about 75 ppm calcium, about 0.001 to about 0.25 wt. % grain refiners, the balance essentially aluminum with incidental elements and impurities, and being essentially beryllium-free.

18. The alloy of claim 17, wherein the concentration of calcium is from about 15 to about 75 ppm calcium.

19. The alloy of claim 17, wherein the grain refiners are selected from the group consisting of titanium, strontium, boron and carbon.

20. The alloy of claim 17, wherein titanium is a grain refiner at a concentration from about 0.0002 to about 0.20 wt. % and boron is a grain refiner at a concentration from about 0.0001 to about 0.03 wt. %.

21. The alloy of claim 17, wherein titanium is a grain refiner at a concentration from about 0.0002 to about 0.20 wt. % and carbon is a grain refiner at a concentration from about 0.00001 to about 0.001 wt. %.

22. The alloy of claim 21, wherein the concentration of calcium is from about 8 ppm to about 14 ppm.

23. An ingot cast from the aluminum alloy of claim 17.

24. An aluminum alloy having improved as-cast surface quality, said alloy consisting essentially of: about 7.6 to about 8.4 wt. % zinc, about 2.0 to about 2.6 wt. % copper, about 1.8 to about 2.3 wt. % magnesium, about 0.08 to about 0.25 zirconium, about 5 to about 75 ppm calcium, about 0.001 to about 0.25 wt. % grain refiners, the balance essentially aluminum with incidental elements and impurities, and being essentially beryllium-free.

25. The alloy of claim 24, wherein the concentration of calcium is from about 15 to about 75 ppm calcium.

26. The alloy of claim 24, wherein the grain refiners are selected from the group consisting of titanium, strontium, boron and carbon.

27. The alloy of claim 24, wherein titanium is a grain refiner at a concentration from about 0.0002 to about 0.20 wt. % and boron is a grain refiner at a concentration from about 0.0001 to about 0.03 wt. %.

28. Tho alloy of claim 24, wherein titanium is a grain refiner at a concentration from about 0.0002 to about 0.20 wt. % arid carbon is a grain refiner at a concentration from about 0.00001 to about 0.001 wt. %.

29. The alloy of claim 28, wherein the concentration of calcium is from about 8 ppm to about 14 ppm.

30. An ingot cast from the aluminum alloy of claim 24.

* * * * *